US006435098B1

(12) United States Patent
Peterson et al.

(10) Patent No.: US 6,435,098 B1
(45) Date of Patent: Aug. 20, 2002

(54) SUSPENSION SYSTEM FOR A RAILWAY REPAIR MACHINE

(75) Inventors: Leary Peterson, Franklin; William D. Straub, Milwaukee, both of WI (US)

(73) Assignee: Nordco Inc., Milwaukee, WI (US)

( * ) Notice: Subject to any disclaimer, the term of this patent is extended or adjusted under 35 U.S.C. 154(b) by 0 days.

(21) Appl. No.: 09/809,982

(22) Filed: Mar. 16, 2001

(51) Int. Cl.[7] ..... E01B 29/02
(52) U.S. Cl. ..... 104/2; 105/453
(58) Field of Search ..... 104/2, 3, 4, 9; 105/453

(56) References Cited

U.S. PATENT DOCUMENTS 3,361,087 A * 1/1968 Dean ..... 105/198.1
3,941,061 A 3/1976 Schindehütte et al.
4,316,418 A 2/1982 Hindin et al.
4,344,656 A 8/1982 Masterson, Jr. et al.

* cited by examiner

*Primary Examiner*—S. Joseph Morano
*Assistant Examiner*—Robert J. McCarry, Jr.
(74) *Attorney, Agent, or Firm*—Greer, Burns & Crain, Ltd.

(57) ABSTRACT

A suspension system configured to provide suspension to a railroad maintenance machine having a frame and a chassis, where the suspension system is selectively operable between work and transportation modes of the machine. The suspension system includes a suspension that is operable between a first position and a second position. The first position is when the suspension is substantially inflated for transportation of the machine, and the second position is when the suspension is substantially deflated for conducting railroad maintenance. Contact with the rail is maintained in either position.

19 Claims, 3 Drawing Sheets

SUSPENSION SYSTEM FOR A RAILWAY REPAIR MACHINE

BACKGROUND OF THE INVENTION

This invention relates to suspension systems used to provide support to railway vehicles during transportation, and more particularly to a pneumatic suspension system for railway repair machines that is selectively operable during transportation.

Shock and vibrations are substantial in railway and commercial truck transportation. The sudden bouncing or vibrations during railway and truck travel disrupts passenger comfort, can damage cargo and can also reduce the operational life of the vehicles themselves. Thus, trains and trucks require adequate support or cushioning during transportation to reduce the disruptive shock and vibrations caused to the vehicle. To control the disruptive shock and vibrations, conventional transportation vehicles use mechanical springs or air springs to support the vehicle's body over the chassis. Air springs derive their suspension properties from resilient air-filled bladders, are primarily used in the trucking industry and are located near the front and rear axles of a truck body.

Similarly, railway repair machines tropically have a suspension system that utilizes mechanical springs for support. Like the air spring systems, conventional mechanical spring systems are designed to reduce shock and vibration to the operator and machine components during transportation. When the repair machines reach their destination, the machines stop and prepare for operation. In operation, the mechanical suspension system must be manually locked out to prevent swaying or rocking during a repair or maintenance procedure. If the machine is allowed to rock or sway, it could cause damage to the track portion being repaired or allow the machine to lift off the track and derail, or provide poor and/or inconsistent rail maintenance. Rocking or swaying during rail repair makes it more difficult for the operator to accurately control the repair operation.

Therefore, the operator must manually rigidly lock the suspension system in place prior to operation by placing a solid object or suspension cylinder between the machine frame and the suspension arm underneath the mechanical spring. The cylinder holds the frame and the suspension arm apart and prevents the machine from rocking during repair procedures because the mechanical springs are not supporting the frame.

A related disadvantage of rigidly locking the suspension is that since the frame is locked at the four points of contact with the rail, uneven rails tend to reduce the stability of the machine due to loss of wheel contact with the rail.

Thus, a major disadvantage of the conventional railway repair machine suspension systems is that the mechanical spring system must be manually locked in place by the operator before beginning any work. Subsequently, the suspension system must be manually unlocked prior to transportation. The manual locking and unlocking of the mechanical suspension system on the railway repair vehicles takes substantial time and effort by the operator.

Therefore, there is a need for a suspension for a railway repair vehicle which does not require manual locking down prior to performance of the maintenance operation.

Accordingly, it is the primary object of the present invention to provide an improved suspension system for railway repair machines that is selectively operable and that greatly increases the stability of the repair machine during railway maintenance procedures.

It is another object of this invention to provide an improved suspension system for railway repair machines that is easy to control and requires minimal operator manipulation to activate and deactivate the system.

It is a further object of this invention to provide an improved suspension system for railway repair machines that increases operator safety and comfort during transportation of the machine, and minimizes rocking and swaying of the machine during immobilization and operation of the machine for railway repair procedures.

BRIEF SUMMARY OF THE INVENTION

The above-listed objects are met or exceeded by the present improved suspension system which provides selective support between the frame and chassis of a railway repair machine. The system is inflatable when the machine travels along the railway and is deflatable to provide a more secure base for a rail maintenance operation.

More specifically, the present suspension system is for a railroad maintenance machine having a frame and a chassis, where the su:pension system is selectively operable during transportation of the machine. The suspension system includes a suspension mechanism for providing suspensive support to the frame relative to the chassis and operable between a first position, when the suspension mechanism is substantially inflated for transportation of the machine, and a second position, when the suspension mechanism is substantially deflated for conducting railroad repairs and maintenance. A control mechanism allows operator selection of the suspension mechanism between the first and second positions.

Thus, when selectively deflated by the operator, the present suspension mechanism provides a relatively rigid relationship between the chassis and the frame. Consequently, railway repairs can be made from a !;table operational base.

BRIEF DESCRIPTION OF THE SEVERAL, VIEWS OF THE DRAWINGS

DETAILED DESCRIPTION OF THE INVENTION

Figure 1:
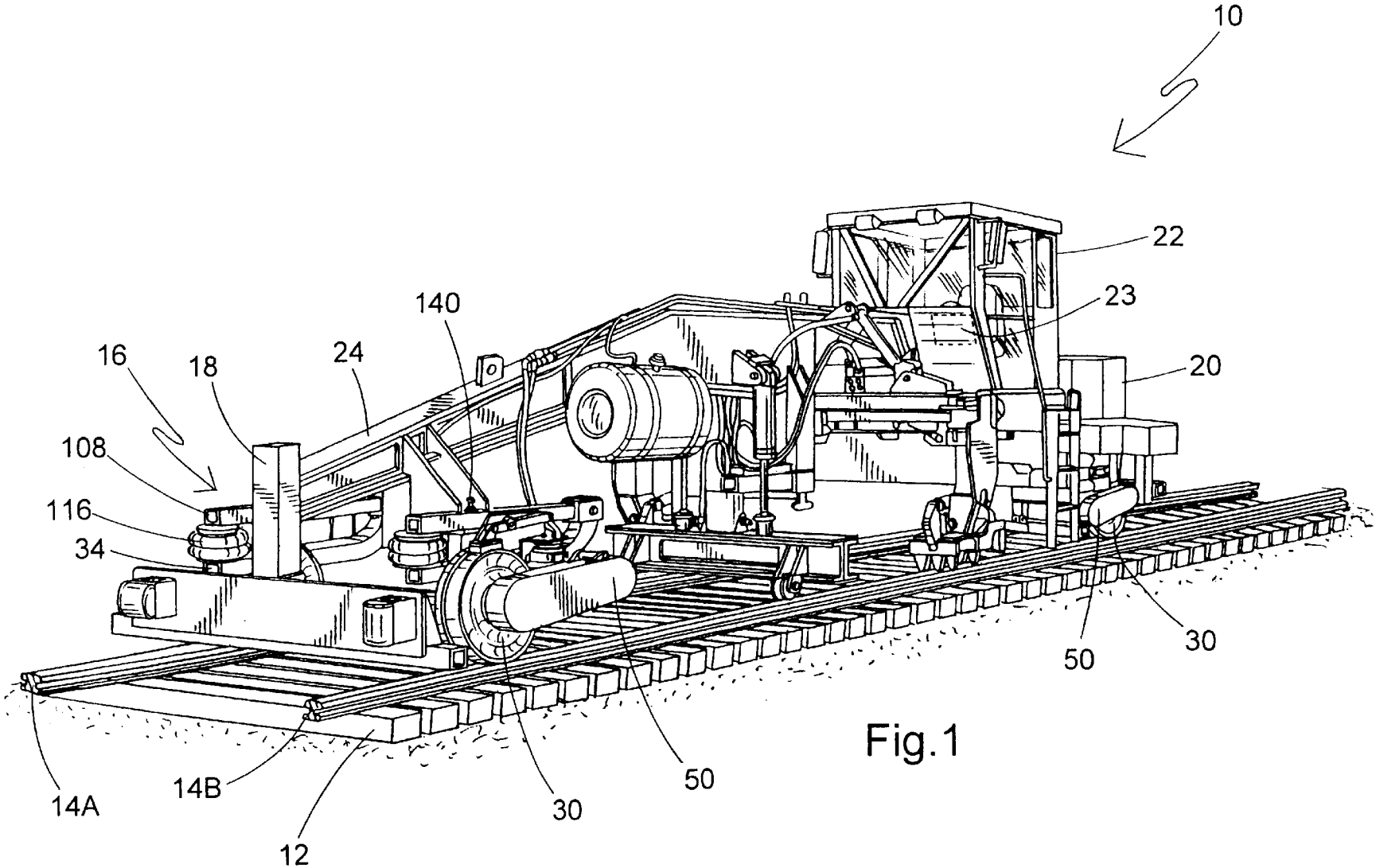
FIG. 1 is a first perspective view of a railway repair machine featuring the present suspension system.

Referring now to FIG. 1, a railway repair machine is generally designated 10. While the machine 10 is depicted as a rail tie extractor/inserter, it is contemplated that the present suspension may be employed on other types of railway maintenance vehicles, as are well known in the art, including but not limited to spike pullers, anchor removers, spike drivers, rail bores, adzers, grinders and rail clip applicators/removers.

During transportation, the railway repair machine 10 travels along a railroad track 12 having rails 14*a* and 14*b*. The repair machine 10 stops at a location on the track 12 that is targeted for maintenance. While traveling on the track 12, the repair machine 10 experiences shock and vibrations. To reduce the shock and vibrations during travel, a suspension system, generally shown as 16, is located in at least one of a front end 18 and a rear end 20 of the machine 10. In the preferred embodiment, the system 16 is provided to both the front and rear ends 18, 20. Since the same system 16 is located at each of the front and rear ends 18, 20, only one such apparatus is described below. An operator may selectively operate the suspension system 16 from in operator's cab 22 by using a control panel 23.

Figure 2:
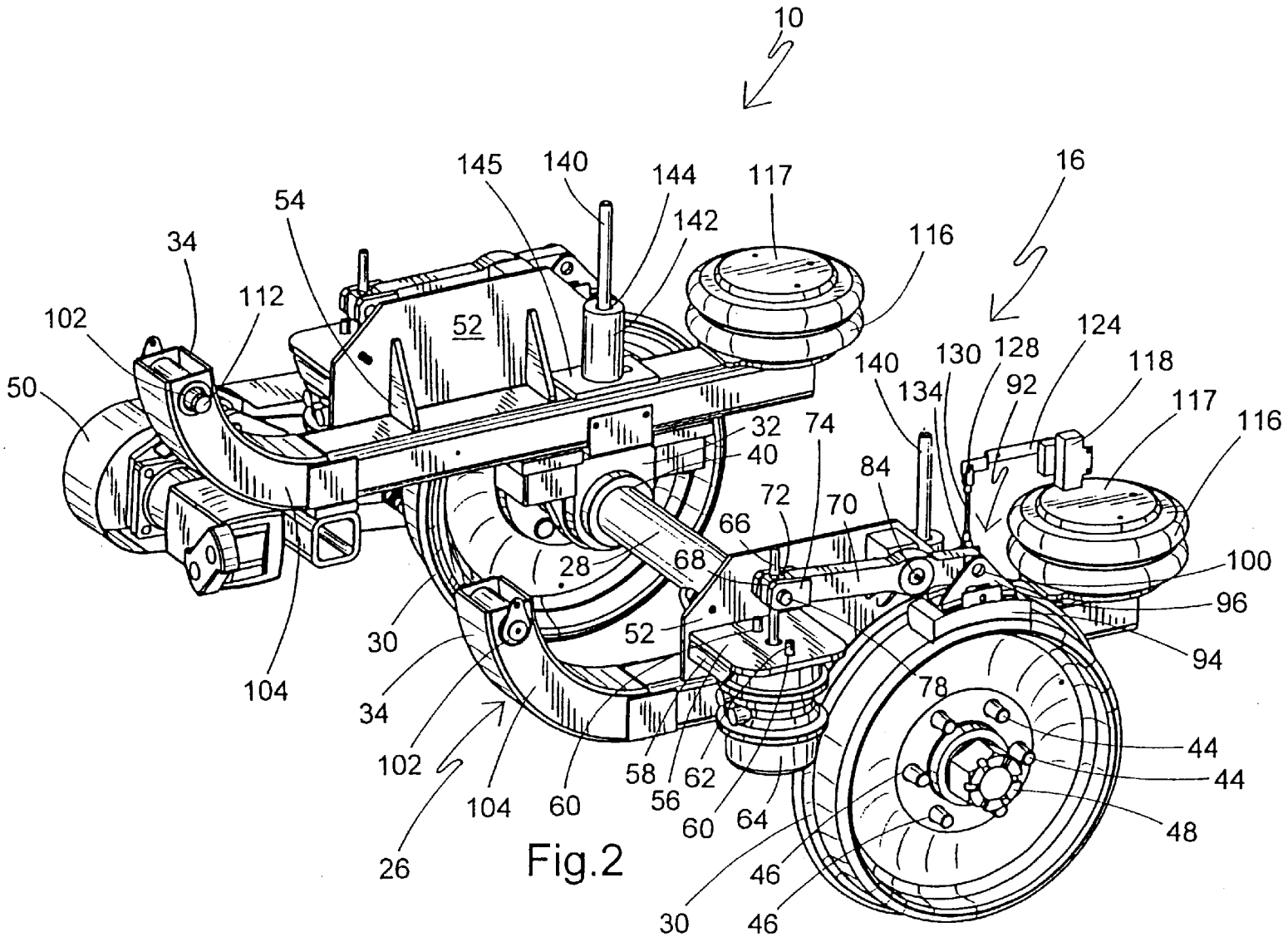
FIG. 2 is a fragmentary top perspective view of the rear chassis of the machine of FIG. 1, including the present suspension system.
Figure 3:
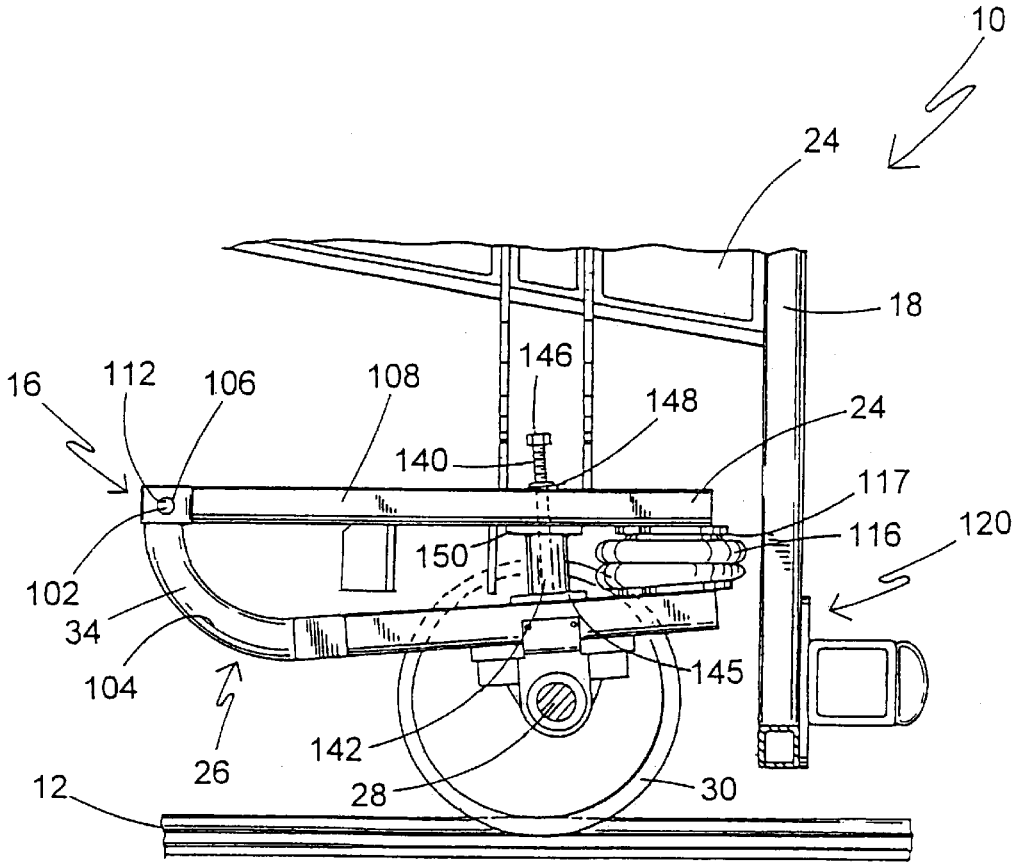
FIG. 3 is a fragmentary side elevational view of the present suspension in the deflated position.
Figure 4:
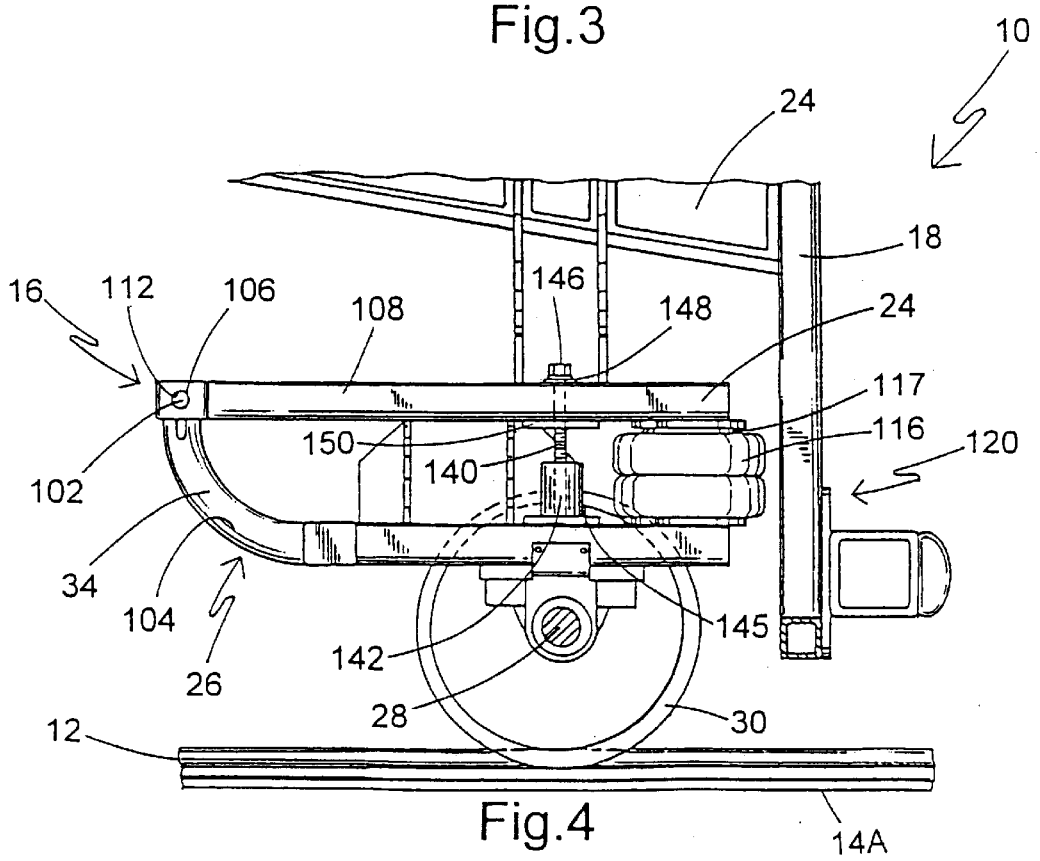
FIG. 4 is a fragmentary side elevational view of the present suspension in the inflated position.

Now referring to FIGS. 2–4, the suspension system 16, which is preferably pneumatic, is configured to support a frame 24 on a chassis, generally designated 26. Hydraulic suspension systems are also contemplated Its being suitable for use with the present invention. To facilitate transportation of the machine 10, the front end 18 and the rear end 20 are each supported by the chassis 26 that includes an axle 28, a pair of wheels 30 secured to the axle 28, and a pair of axle support members 2;2. Each axle support member or pillow block 32 is secured to a corresponding suspension aim 34. Furthermore, the support members 32 have a throughbore 40 that corresponds to the circumferential size of the axle 28, allowing the axle to be freely and rotatably held by the frame 24 after sliding the axle 28 into each throughbore.

On each end of the axles 28, one grooved wheel 30 is attached such that the wheels engage the railroad track 12 for travel. The wheels 30 are mounted to ends of the axle 28 that extend through each support member 32, which are outboard of the suspension arms 34. Several studs 44 located on the ends of the axles 28, project through corresponding openings 46 on the wheels 30 to hold each wheel in place. Each wheel 30 is then secured to the chassis 26 by a hub 48 that is attached to each end of the axle 28. The hubs 48 and the wheels 30 are removable for repair or replacement.

A propulsion assembly 50 is secured to at least one end of at least one of the axles 28, and has a drive chain (not shown) and a propulsion motor (not shown). In operation, and as is well known in the art, the motor rotates a small drive wheel (not shown) which in turn, rotates the drive chain positioned over a slotted hub (not shown) located on the outside of the wheel 30. The rotating chain turns the hub and railway machine wheel 30, thereby propelling the machine 10 along the track 12. Other conventional machine drive systems are also contemplated as equivalents for this arrangement.

Each suspension arm 34 is affixed to the chassis 26 by welding and/or fastening devices known in the art. The suspension arms 3,4 have a flange or plate 52 that vertically projects from an upper surface of each arm 34. The: plates 52 are secured to each suspension arm 34, preferably by welding, and are supported by triangular support brackets or gussets 54, which are preferably welded between the plates 52 and the suspension arms 34.

In addition, a support plate 56 including a pair of depending brackets 58, extends transversely from the outside portion of each plate 52 and is preferably welded directly thereto. Each support plate 56 has three holes, where the outside holes 60 accept corresponding connection rods 62 that project from a brake chamber 64. Each brake chamber 64 is pneumatically powered and is positioned below the corresponding support plate 56, and secured to the plates 56 by the connection rods 62. A centrally located, elongated piston rod 66 extends vertically from each brake chamber 64 and passes through a corresponding hole in the middle of the support plate 56.

Attached to one end of the piston rod 66 is a brake lever guide block 68 which attaches to a brake lever 70. The guide block 68 hers an axial hole 72 and fits into a clevis bracket 74 which is located on the end of the brake lever 70. A pivot shaft 78 secures the guide block 68 within the clevis bracket 74. Once the piston rod 66 passes through the support plate 56, it is inserted through the hole 72 in the guide block 68 and secured to the block, as by jam nuts or other fasteners known in the art.

Reciprocation of the piston rod 66 moves the guide block 68, which correspondingly moves the brake lever 70 up or down. The lever 70 pivots about a pivot axis 84, located on the plate 52.

Attached to the opposite end of the brake lever 70 is the brake assembly 92, which includes a brake shoe 94, brake head 96 and associated fastening devices. The brake shoe 94 is connected to the brake head 96 to allow for pivoting of the brake shoe 94 about its connection point 100. This tilting movement allows the brake shoe 94 to maintain maximum surface contact with the varying contours; of the wheels 30 during braking of the machine 10 such that optimal deceleration of the wheels is achieved. This pivoting action is under operator control as braking of the machine 10 is desired.

Now focusing on the connection between the frame 24 and the chassis 26, each suspension arm 34 has an opening 102 located at the end of a curved portion 104 of the suspension arm 34. The opening 102 aligns with a similar opening 106 (FIGS. 3 and 4) on an elongate bar portion 108 of the frame 24 that is positioned above the suspension arm 34 and over the chassis 26. A suspension pivot pin 112 is inserted into the aligned openings 102, 106 and slid through bushings (not shown), and through both the suspension arm 34 and the bar portion of the frame 24 to form a pivot joint. After the pin 112 is inserted, it is secured in place by a washer and a threaded fastener (not shown) or other fastening technology as known in the art.

On the opposite end of the suspension arm 34, at least one flexible container 116 is positioned at each corner of the machine 10 on an upper surface of the suspension arms 34. Each flexible container 116 is manufactured of a resilient material that is strong enough to prevent failure under elevated air pressure conditions, and durable enough to expand and compress during inflation and deflation operations. Acceptable materials include, but are not limited to, various grades of rubber and equivalent materials known in the art. In the preferred embodiment, each flexible. container 116 is provided as a circular, (when viewed from above) bellows-type member. However, other known collapsible members are contemplated. Rigid contact pads or plates 117 are disposed at upper ends of the flexible containers 116 for reinforcement purposes.

Each flexible container 116 is secured at respective lower and upper ends to the suspension arm 34 and the frame 24 using the Fads 117. As depicted in FIGS. 3 and 4, the flexible containers 116 are situated between the suspension arms 34 and the frame 24. As the flexible containers 116 inflate due to air supplied by the pneumatic system of the machine 10, they expand between the opposing suspension arm 34 and the portion 108 of the frame 24. This expansion suspends the frame 24 above the chassis 26, and the compressed air within the flexible container 116 provides a corresponding amount of resilient cushioning of the frame relative to the chassis. In contrast, releasing the air from each flexible container 116 decreases the internal air pressure, causes deflation of the flexible containers, and reduces the amount of suspending force provided by the flexible containers 116 against the frame 24. Upon full deflation, contact is created between the frame 24 and the chassis 26. As seen when FIGS. 3 and 4 are compared, when the flexible containers 116 are deflated, the weight of the frame 24 will cause the chassis 26 to pivot downward about the pin 112. In contrast, upon inflation of the flexible container 1 16, the distance between opposing free ends of the frame 24 and the chassis 26 will increase.

Referring now to FIG. 2, a control valve 118 is positioned on top of each flexible container 116 to measure the vertical height of the flexible container, which is a function of the pressure of air contained inside. A suitable control valve 118 is manufactured by Neway Anchorlock International, Muskegon, Mich., under designation "CR Height Control Valve". Operation of the control valve 118 is (effected at the control panel 23 in the operator's cab 22 where the operator turns the suspension 'on' or 'off'. In the 'on' position, the flexible containers 116 are in a first position 120. the inflated mode (FIG. 4). In a second or 'off' position 122, the flexible containers 116 are in deflated mode (FIG. 3). This system also monitors relative height of each wheel 30 of the chassis 26.

The control valve 118 is attached to one end of a lever arm 124. The opposite end of the lever arm 124 is pivotally secured to an upper clevis bracket 128 by a clevis pin. Between the lever arm 124 and the chassis 26 is an elongated metal shaft 130 that is attached to the clevis bracket 128. The other end of the shaft 130 extends vertically downward and is attached to a lower clevis bracket 134 which is secured to the suspension arm 34 by a clevis pin (not shown).

In operation, the control valve 118 reciprocates vertically with the expansion and contraction of the flexible container 116, and correspondingly, the movement of the frame 24. As is well known, the relative elevation cf the control valve 118 will vary with the amount of pressure the inside flexible containers 116, and the weight of the frame 24. As the flexible container 116 inflates, the frame 24 is suspended above the chassis 26, and the control valve 118 rises along with the frame. When the control valve 118 rises, the lever 124 pivots, thereby controlling the amount of air to be plimped to the flexible container 116. As the machine 10 is transported, any variations in height of the flexible container 116 will trigger the movement of the valve 118, and corresponding activation of the lever 124. Pressurized air is added or released as needed to keep the valve 118 at a constant height during transport of the machine 10. In this manner, a generally constant height of the frame 24 is maintained relative to the chassis 26. Subsequently, when the frame 24 is lowered, or is in the second position 122, during immobilization of the repair machine 10, the control valve 118 moves with the lowering of the frame 24.

During inflation and deflation of the flexible containers 116, the suspension arms 34 pivot relative to the frame 24 at the pivot pins 112. As the arms 34 pivot, the frame 24 us allowed to slide vertically along an elongated, generally vertically oriented shaft 140, which is secured to the suspension arm 34 and is preferably at least partially threaded (FIG. 3). The shaft 140 passes through an oversized aperture in the elongate bar portion 108 of the frame 24. It will be seen that the pivoting action shown in FIG. 3, when the flexible containers are deflated, will cause some lateral displacement of the shaft 140.

The stop 142 has a central, axial opening 144, which slidably engages the shaft 140 until the stop 142 rests upon the suspension arm 34 either directly, or upon a support plate 145, causing contact between the frame 24 and the chassis 26. Such contact occurs when the flexible container 116 is deflated, thus effecting metal-to-metal frame/suspension arm contact for more positively controlled maintenance operations. This contact also reduces load on the deflated flexible containers 116 prolonging their operational life. To prevent the frame 24 from sliding off the upper end of the shaft 140, a washer 146 and a locknut 148 (FIGS. 3 and 4), or suitable equivalent fasteners, are attached to an upper end of the shaft 140. If desired an additional support plate 150 may be secured to the underside of the bar portion 108.

During transportation, the suspension system 16 is selectively operable between the first position 120 and the second position 122. The first position 120 is selected by an operator (not shown) for transportation of the repair machine 10 by utilizing the control panel 23 located in the operator's cab 22. This relays a signal to a compressor (not shown) to deliver air to the suspension system 16 located at :each corner of the frame 24. The first position 120 occurs when the preferably pneumatic suspension system 16 is substantially inflated for transportation. The inflated flexible containers 116 absorb rail bed-induced shocks and vibrations.

When the railway repair machine 10 reaches the desired location on the track 12, the vehicle 10 is stopped. The operator then utilizes the control panel 23 to activate the suspension system 16 to proceed to the second position 122. To achieve the second position 122, the suspension system 16 releases air from the containers 116 and effects contact as described above between the frame 24 and the chassis 26 using the stop 142. Since the entire weight of the frame 24 and other machine components is resting directly on the chassis 26, the contact between the frame 24 and the chassis 26 provides increased stability to the railway repair machine 10 during railroad repair and maintenance operations.

An advantage of the present suspension system 16 is that, with the present independently operating suspension system 16 located at each of the corners of the frame 24, where the wheels 30 are located, any deviations in rail height or alignment are compensated for. In other words, on a level track, when the system is placed in the second position 122, the frame 24 settles down to the stop 142 at each wheel 30. However, if the track 12 is not level, the frame 24 may settle down to the stop 14 at only three wheels. In this way, the machine 10 remains incontact with the track 12 at all four wheels 30, and the frame 24 solidly rests on the chassis 26. This arrangement provides for positive contact with the frame 24 and the chassis 26 for rail maintenance purposes;, and also provides for greater stability of the machine 10 upon the track 12. Due to the independent operation of the present suspension system 16 at each wheel 30, the stop position may vary at each wheel 30, depending on the alignment or condition of the rail. Upon completion of the repair, the operator actuates the control panel 23 to reinflate the flexible member 116 for transport of the machine 10.

Thus, a major feature of the present railway vehicle suspension system 16 is the ability to selectively operate between an inflated position and a deflated position, such that the inflated position suspends the railway machine frame above the chassis for shock absorption during transportation, and the deflated position effects contact between the frame and the chassis for increased stability during railway repair procedures. Another feature is that the suspension is easily controlled from the operator's cab and is thereby safer for the operator and more efficient.

While a particular embodiment of the railway machine suspension system has been shown and described, it will be appreciated by those skilled in the art that changes and modifications may be made thereto without departing from the invention in its broader aspects and as set forth in the following claims.

What is claimed is:

1. A suspension system for a railroad maintenance machine having a frame and a chassis, said suspension system being selectively operable during transportation of the machine, said system comprising;

suspension means for providing suspensive support to the frame relative to the chassis and operable between a first position when said means are substantially inflated for transportation of the machine, and a second position when said means are substantually deflated for conducting railroad maintenance;

said suspension means configured at said first position to obsorb rail beb-induced shocks and vibrations;

said suspension means configured at said second, substantually-deflated, position to effect contact between the frame and the chassis, so that the entire weight of the frame and the other machine componets is resting directlt on the chassis to provide increased stability during railroad repair and maintenance; and control means connected to said suspension means for selectively placeing said suspension means in one of said first and second positions.

2. The system as defined in claim 1 wherein said suspension means further comprises at least one flexible container being disposed between opposing elements of the frame and chassis.

3. The system as defined in claim 2 wherein the frame has four corners, and further comprising at least one flexible container disposed in each corner of the frame.

4. The system as defined in claim 2, wherein said suspension means includes a suspension arm on said chassis pivotally engaged to said frame, said at least one flexible container disposed between said frame and said arm, and a stop member for effecting contact between said frame and said chassis upon deflation of said flexible member.

5. A suspension system for a railroad maintenance machine having a frame and a chassis, the suspension system being selectively operable during transportation of the machine, said system comprising:

at least one flexible container disposed between opposing elements of the frame and the chassis to selectively suspend the frame relative to the chassis, and when selectively deflated, to effect contact between the frame and the chassis. a control mechanism configured for selectively regulating gas flow into said at least one flexible container to obtain said selective inflation and deflation.

6. The system as defined in claim 5, wherein said suspension system includes a suspension arm on said chassis pivotally engaged to said frame, said at least one flexible container disposed between said frame and said arm, and a stop member for effecting contact between said frame and said chassis upon deflation of said flexible member.

7. The system as defined in claim 5 wherein said at least one flexible container is a generally circular, bellows type member.

8. The system as defined in claim 5 further including an indicator apparatus for indicating the relative inflation of said at least one flexible container.

9. The system as defined in claim 8 wherein said indicator apparatus is a control valve configured for moving with said expanding and contracting flexible member to control inflation of said flexible member to maintain a desired relative position between said frame and said chassis.

10. A method for supporting the frame of a railroad maintenance machine on a chassis by using at least one flexible container disposed between the frame and the chassis that suspends the frame above the chassis when said at least one flexible container is selectively inflated and when selectively deflated, effects contact between the frame and the chassis, said method comprising:

displacing the frame from the chassis by deflating the flexible container with a gas prior to transportation of the machine;

transporting the machine to a desired location;and releasing the gas from the flexible container and placing the fram in contact with the chassis.

11. The method as defined in claim 10 further comprising selectively regulating gas flow into said at least one flexible container to obtain said selective inflation and deflation.

12. A rail tie replacement machine configured to remove and replace rail ties from either side of a railroad track, said machine comprising:

a frame;

a chassis;

a suspension system disposed between said frame and chassis, said suspension system configured to suspend said frame above said chassis during transportation, and effecting contact between said frame and chassis during operation.

13. The machine as defined in claim 12 wherein said suspension system further includes at least one flexible container.

14. The machine as defined in said claim 13 wherein said frame includes at least one elongate bar portion pivotally engaged at one to said chassis.

15. The machine as defined in claim 14 wherein said bar portion has opposite end operationally engaged to a corresponding flexible container.

16. The machine as defined in claim 12 further including a control system for selectively causing said suspension of said frame relative to said chassis.

17. The machine as defined in claim 16 including at least one flexible container for creating a cushion gap between said frame and said chassis, said control system configured selectively for causing the inflation of said flexible containers.

18. The machine as defined in claim 12 further including a stop mechanism configured for supporting said frame relative to said chassis when said at least one container is deflated.

19. The machine as defined in claim 12 wherein said chassis is provided with a plurality of wheels, and said suspension system includes a plurality of suspension assemblies, each associated with a corresponding wheel, said suspension assemblies operating independently of each other so that, during operation, when said contact is effected between said frame and said chassis, each said wheel stays in contact with underlying railroad track, regardless of whether the underlying railroad track is uneven.

* * * * *